US005631619A

United States Patent [19]

Evans

[11] Patent Number: 5,631,619

[45] Date of Patent: May 20, 1997

[54] FEMALE AUTOMOTIVE FUSE HAVING FUSE CLIPS ELECTRICALLY CONNECTED TO CONDUCTIVE THERMAL BLOCKS

[75] Inventor: Terence J. Evans, Ballwin, Mo.

[73] Assignee: Cooper Industries, Inc., Houston, Tex.

[21] Appl. No.: 407,356

[22] Filed: Mar. 20, 1995

[51] Int. Cl.[6] ..... H01H 85/02

[52] U.S. Cl. ..... 337/198; 337/186; 337/166

[58] Field of Search ..... 337/186, 197–198, 337/166; 29/623

[56] References Cited

U.S. PATENT DOCUMENTS

| | | | |
|---|---|---|---|
| 2,055,866 | 7/1936 | Jung et al. | 209/135 |
| 4,570,147 | 2/1986 | Ebi | 337/166 |
| 4,635,023 | 1/1987 | Oh | 337/163 |
| 4,646,052 | 2/1987 | Matsunaga et al. | 337/166 |
| 4,672,352 | 6/1987 | Takano | 337/264 |
| 4,800,358 | 1/1989 | Takenouchi et al. | 337/268 |
| 4,808,962 | 2/1989 | Ikeda | 337/203 |
| 5,262,751 | 11/1993 | Kudo et al. | 337/296 |
| 5,294,906 | 3/1994 | Totsuka et al. | 337/260 |

*Primary Examiner*—Leo P. Picard
*Assistant Examiner*—Jayprakash N. Gandhi
*Attorney, Agent, or Firm*—Burns, Doane, Swecker & Mathis LLP

[57] ABSTRACT

A female fuse having a one piece fuse link and thermal mass injection molded around a multifinger fuse clips. The fuse link, thermal mass, and fuse clip are enclosed in an insulating housing. The resulting fuse is smaller in size and operates at a cooler temperature than other fuses.

20 Claims, 2 Drawing Sheets

FEMALE AUTOMOTIVE FUSE HAVING FUSE CLIPS ELECTRICALLY CONNECTED TO CONDUCTIVE THERMAL BLOCKS

BACKGROUND OF THE INVENTION

This invention relates to fuses in general, and in particular to a female fuse with a fuse clip insert molded into a one piece fuse link and thermal block.

Prior art automotive fuses have a number of significant drawbacks associated with their design and operation. State of the art fuses are, for the most part, male, blade type fuses. There fuses plug into fuse blocks which have metal, spring clips. During operation and overload conditions, these spring clips can anneal, causing them to lose their flexibility. When this happens, not only must the fuse be replaced, but the fuse block must be disassembled to replace the clips. This is expensive and labor intensive.

Another problem with male type automotive fuses is that the fuse block contains a connecting piece, such as a double female clip, between the bus bar and the fuse blades. This extra component adds additional cost, increases the size of the product, and requires additional labor to assemble.

Prior art patents have met with limited success in seeking a solution to these problems. Yazaki, et al., U.S. Pat. No. 5,294,906, shows a male fuse and a mechanism for trapping the link in the body. The purpose is for preventing the housing from being deformed and discolored due to generation of heat. Jung et al., U.S. Pat. No. 2,055,866, shows a moveable heat accumulator to vary the overload characteristics of the link. Matsunaga, U.S. Pat. No. 4,646,052, uses high melt temperatures to avoid the "M" effect. In the Jung et al. and Matsunaga et al. patents, the accumulators are separate pieces added to the link and raise the cost of manufacturing.

SUMMARY OF THE INVENTION

The present invention incorporates a fuse clip which is insert molded into a thermal block. The thermal block and fuse link are injection molded in a one piece unit. A female fuse incorporating this invention is smaller in size, operates cooler, and does not require soldering or welding of the parts.

DETAILED DESCRIPTION OF THE INVENTION

Figure 1:
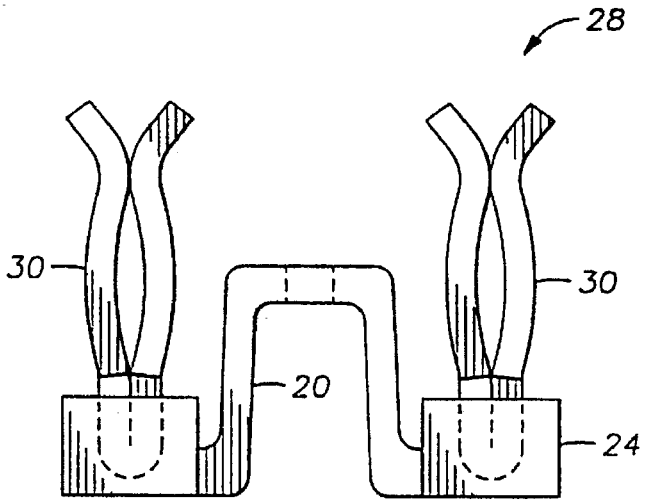
FIG. 1 is a plan view of a fuse element sub-assembly according to the present invention.
Figure 2:
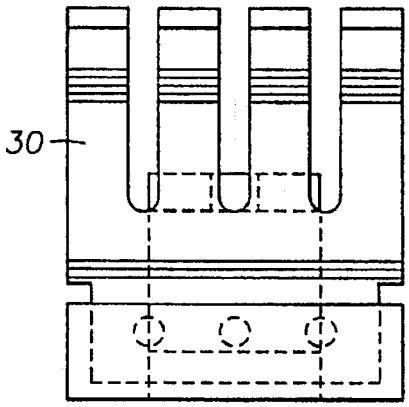
FIG. 2 is a plan view from the right side of the fuse element sub-assembly shown in FIG. 1.
Figure 3:
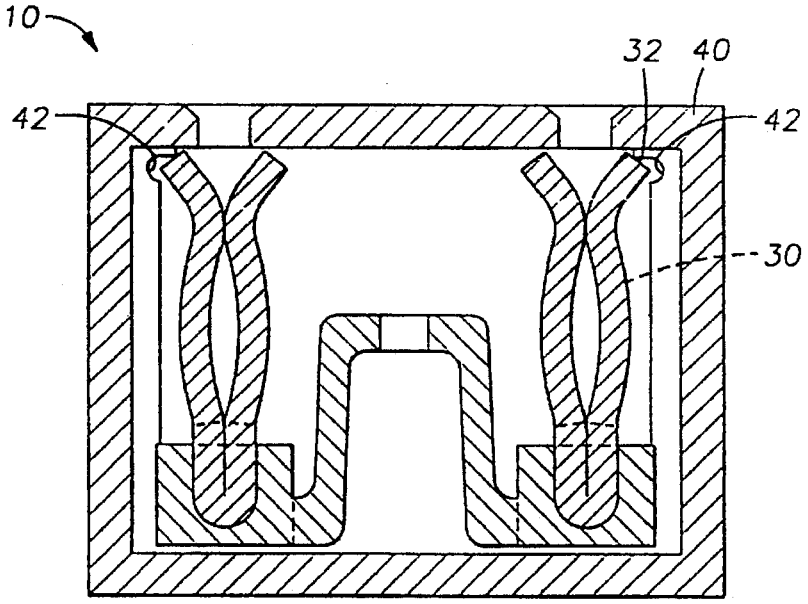
FIG. 3 is a sectional view, partially in phantom, of a female fuse according to the present invention.

Referring now to FIGS. 1 and 3, the female fuse is referred to in general by reference numeral 10. The major components of female fuse 10 are element assembly 28 and housing 40, shown in FIG. 3 and FIG. 4.

The element assembly is comprised of female fuse clips 30, thermal block 24, and fuse link 20. Fuse link 20 and thermal blocks 24 are injection molded as a one piece unit. Fuse clips 30 are encapsulated into each thermal block during the molding process. As the metal used for thermal block 24 and fuse link 20 cools, it contracts and locks the fuse clips 30 into place. This construction eliminates the need for soldering or welding parts together, and hence reduces the cost of fuse 10.

Thermal block 24 serves as a heat sink for fuse link 20. The heat sink characteristics enable the fuse to operate with a time delay. Thus, fuse link 20 will not open on short duration over current conditions.

The metal used for injection molding fuse link 20 and thermal block 24 is a low melting temperature metal such as tin-silver, tin-phosphorus, tin-antimony, or other alloys and pure metals with melt or transition temperatures lower than 300 degrees C. Using low temperature metals insures that the fuse will clear at lower electrical overload values, which eliminates the need to make other design changes to prevent body deformation during high temperature excursions.

Using an injection molding process makes it easy to manufacture fuses with different ratings. The size and shape of the mold can be changed to change the size of the thermal block or fuse link, and the composition of the metal alloy can be changed. Any of these actions will change the rating of the fuse.

The fuse clips 30 are made from a cooper alloy such as tin-bronze, red brass, or ceramic bearing cooper alloys. In the preferred embodiment, fuse clips 30 are stamped out of sheet material and folded to shape.

Figure 4:
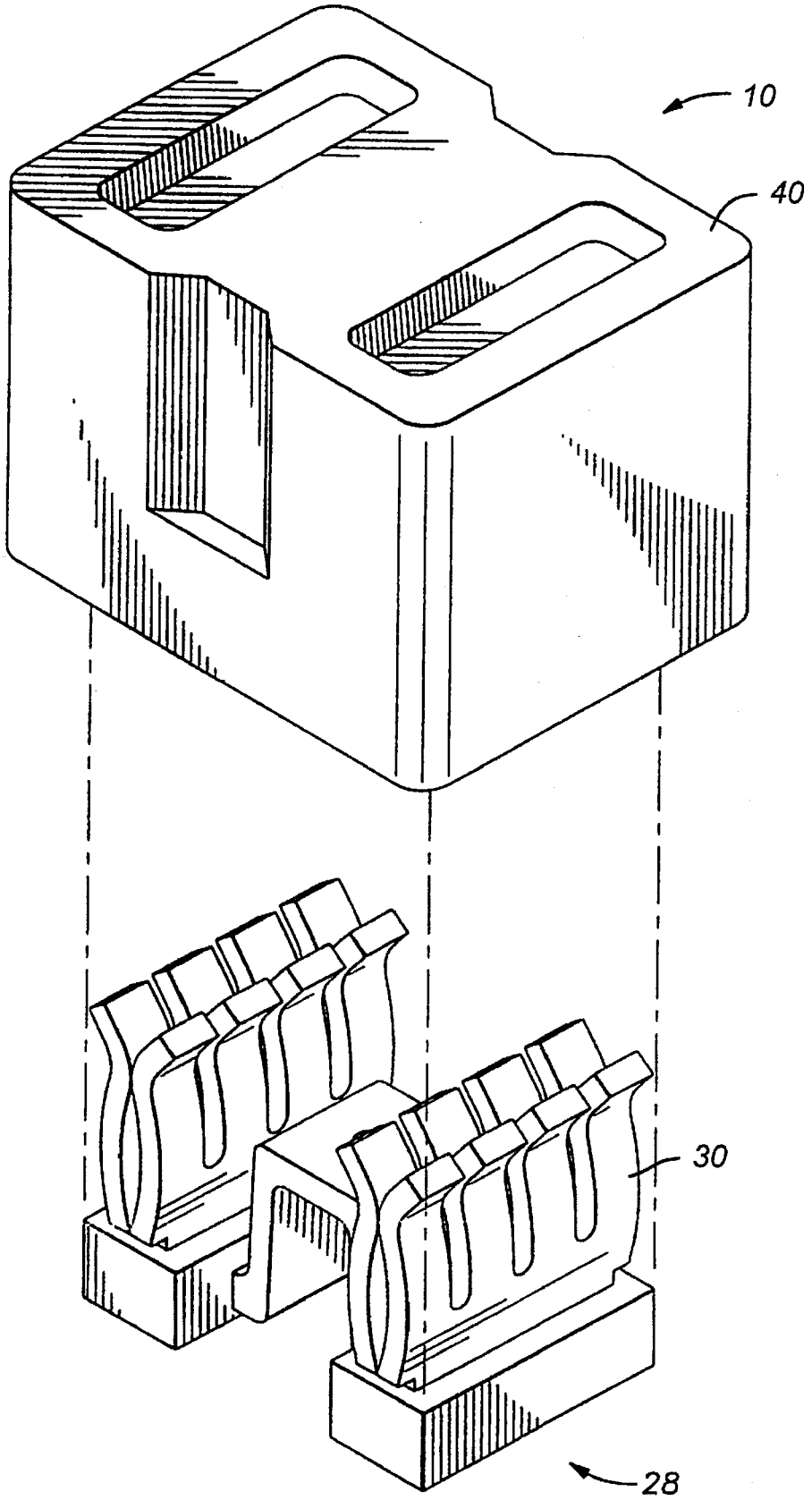
FIG. 4 is a perspective view, partially exploded, of a fuse according to the present invention.

Element assembly 28 is enclosed in an insulating housing 40 such as plastic as shown in FIG. 4. The plastic housing 40 may be injection molded and then assembled around the assembly 28 or constructed by other methods known to the art. Ears 32 on female clips 30 fuse assembly 28 into housing 40 by fitting grooves 42 found in the housing. In the preferred embodiment, grooves 42 are injected molded into the housing.

I claim:

1. A female fuse comprising:

a fuse link;

a first conductive thermal block and a second conductive thermal block electrically connected to said fuse link;

a first female fuse clip and a second female fuse clip electrically connected respectively to said first and second thermal blocks, wherein said fuse clips are insert molded into said thermal blocks, and wherein said fuse link and said thermal blocks are injection molded as a one piece unit, said fuse clips, thermal blocks, and fuse link comprise a fuse assembly; and a housing, enclosing said fuse assembly.

2. A fuse as in claim 1 wherein said fuse clip is a multifinger fuse clip.

3. A fuse as in claim 1 wherein said fuse link and said thermal blocks are injection molded from low temperature metals selected from a group comprising tin-silver, tin-lead, and tin-antimony.

4. A fuse as in claim 1 wherein said fuse link and said thermal blocks are injection molded from alloys having a temperature transition lower than 300 degrees C.

5. A fuse as in claim 1 wherein said fuse clip is a conductive metal selected from a group comprising: copper; copper alloys, including tin bronze, red brass; and ceramic bearing copper alloys.

6. A fuse as in claim 1 wherein said fuse assembly is held in said housing by ears formed on said fuse clips during stamping that interlock into grooves formed in said housing.

7. A fuse as in claim 6 wherein said grooves are formed in said body during molding.

8. A female fuse comprising:

a fuse link;

a first conductive thermal block and a second conductive thermal block electrically connected on opposite sides to said fuse link;

a first female fuse clip and a second female fuse clip electrically connected respectively to said first and second thermal blocks, said fuse clips, thermal blocks, and fuse link comprise a fuse assembly; and a housing enclosing said fuse assembly.

9. A fuse for an electrical circuit comprising:

a fusible element adapted for connection in the circuit;

a conductive member adapted for connection in the circuit;

a conductive thermal block electrically connected between said fusible element and conductive member to serve as a heat sink for said fusible element.

10. The fuse of claim 9 wherein said thermal block has heat sink characteristics which enable the fuse to operate with a time delay.

11. The fuse of claim 9 wherein said thermal block prevents said fusible element from opening during overcurrent conditions of a short duration in the circuit.

12. The fuse of claim 9 wherein said thermal block is made of a metal with a transition temperature of less than 300 degrees centigrade.

13. The fuse of claim 9 wherein said conductive member has a portion thereof encapsulated in said thermal block.

14. The fuse of claim 9 wherein said fusible element, conductive member and thermal block are housed within an insulating housing.

15. A fuse for an electrical circuit comprising;

a fusible element adapted for connection in the circuit;

a conductive member adapted for connection in the circuit;

a thermal block electrically disposed between said fusible element and conductive member to serve as a heat sink for said fusible element;

wherein said thermal block and fusible element are integral of the same metal and said thermal block includes a mass of metal greater than that of said fusible element.

16. The fuse of claim 15 wherein said metal is a metal alloy and said metal alloy and mass of said thermal block are determined by the rating of the fuse.

17. A fuse comprising:

first and second conductive members;

a fuse link having one end electrically connected to a first conductive thermal block and a second end electrically connected to a second conductive thermal block;

said first and second conductive members electrically connected to said first and second thermal blocks, respectively; and said first and second thermal blocks serving as heat sinks.

18. The fuse of claim 17 further including an insulating housing around said conductive members, fuse link and thermal blocks.

19. The fuse of claim 18 wherein said housing includes a chamber for receiving said conductive members, fuse link and thermal blocks.

20. The fuse of claim 18 wherein said housing includes portions projecting into said chamber for engaging and retaining said conductive members.

* * * * *